US008062059B2

(12) United States Patent
Roneker

(10) Patent No.: US 8,062,059 B2
(45) Date of Patent: Nov. 22, 2011

(54) SWITCHED RECEPTACLE DEVICE WITH LED INDICATION

(76) Inventor: Michael D. Roneker, Portsmouth, NH (US)

( * ) Notice: Subject to any disclaimer, the term of this patent is extended or adjusted under 35 U.S.C. 154(b) by 0 days.

(21) Appl. No.: 12/562,582

(22) Filed: Sep. 18, 2009

(65) Prior Publication Data

US 2010/0261373 A1 Oct. 14, 2010

Related U.S. Application Data

(60) Provisional application No. 61/212,427, filed on Apr. 11, 2009.

(51) Int. Cl.
*H01R 3/00* (2006.01)

(52) U.S. Cl. ..... 439/490

(58) Field of Classification Search ..... 439/490; 362/95; 174/66
See application file for complete search history.

(56) References Cited

U.S. PATENT DOCUMENTS

| | | | | | |
|---|---|---|---|---|---|
| 2,385,620 | A * | 9/1945 | Fleckenstein | 340/687 |
| 2,477,862 | A * | 8/1949 | Cook | 307/114 |
| 2,518,812 | A * | 8/1950 | Oswald | 340/656 |
| 3,169,239 | A * | 2/1965 | Lacey | 340/638 |
| 3,872,319 | A * | 3/1975 | Platzer, Jr. | 307/114 |
| 4,000,405 | A * | 12/1976 | Horwinski | 362/95 |
| 4,038,582 | A * | 7/1977 | Horwinski | 315/129 |
| 4,617,613 | A * | 10/1986 | Rice | 362/95 |
| 4,755,913 | A * | 7/1988 | Sleveland | 362/95 |
| 5,146,385 | A * | 9/1992 | Misencik | 361/56 |
| 5,485,356 | A * | 1/1996 | Nguyen | 362/95 |
| 6,642,452 | B2 * | 11/2003 | Masson | 174/66 |
| 6,827,602 | B2 * | 12/2004 | Greene et al. | 439/490 |
| 7,405,493 | B2 * | 7/2008 | Leo | 307/38 |
| 7,506,990 | B2 * | 3/2009 | Glazner | 362/95 |
| 2005/0012401 | A1 * | 1/2005 | Goodrich | 307/140 |
| 2006/0158040 | A1 * | 7/2006 | McIntosh | 307/114 |
| 2009/0052162 | A1 * | 2/2009 | Richter et al. | 362/95 |

* cited by examiner

*Primary Examiner* — Tulsidas C Patel
*Assistant Examiner* — Harshad Patel
(74) *Attorney, Agent, or Firm* — Mesmer & Deleault, PLLC

(57) ABSTRACT

A switched receptacle device with led indication made up of a standard two-outlet receptacle that has two respective hot terminals and two respective neutral terminals, a resistor electrically connected to a first outlet neutral terminal; an LED having a first lead and a second lead electrically connected by the LED first lead in series with the resistor, and the second lead electrically connected to a first outlet hot terminal; and a rectifier diode electrically connected in parallel across the LED first lead and second lead, whereby the LED is activated whenever a switch has energized a hot terminal.

7 Claims, 3 Drawing Sheets

Fig. 2

SWITCHED RECEPTACLE DEVICE WITH LED INDICATION

BACKGROUND

1. Field of the Invention

The present invention generally relates to 120 V duplex electrical receptacles found in 15A and 20A service.

2. Description of the Related Art

NEC code article 210.70 (A)(1) Exception No. 1 states that in other than kitchens and baths, one of more receptacles controlled by a wall switch shall be permitted in lieu of lighting outlets. This is typically accomplished by first wiring any device box intended to have a switched receptacle during the "rough wiring" phase with three-wire Romex or MC cable. Upon the "finish wiring" phase, the device boxes containing the provisions for switching means are ready to attach to the duplex receptacle.

On any residential, commercial, or spec grade receptacle, small tabs are located on both the hot and neutral terminal sides. A three-wire cable typically consists of a black, red, white, and bare copper ground. On the duplex receptacle, the tab on the hot side is broken off, separating the feeds for the top and bottom receptacles. The black wire is constantly hot, while the red is typically terminated on the wall switch load side. The red and black conductors may be positioned however the electrician desires, switching either the top or bottom receptacle.

Once all the duplex receptacles are installed, e.g. in a bedroom, there is no way for the average person to know which receptacles are switched. Many homes, apartments, condos, hotels, etc., are wired this way to save time in the "finish phase" by not having to hang light fixtures, install recessed light trims, and so forth. Numerous service calls to expensive electricians are placed every year by home buyers who think a room was wired with a dead wall switch, or simply cannot figure out why a receptacle has no power (since some electricians switch the entire duplex receptacle).

What is needed, therefore, is a device and method of easily determining whether a receptacle is switched or not.

SUMMARY

The invention is a device and method that satisfies the need to easily determine whether an electrical receptacle is switched. A device according to the present invention may comprise a two-outlet switched receptacle wired with an LED that turns on when the corresponding switch energizes the circuit. More particularly, the device may comprise a standard two-outlet receptacle having two respective hot terminals and two respective neutral terminals, a resistor electrically connected to a first outlet neutral terminal; an LED having a first lead and a second lead electrically connected by the LED first lead in series with the resistor, and the second lead electrically connected to a first outlet hot terminal; and a rectifier diode electrically connected in parallel across the LED first lead and second lead, whereby the LED is activated whenever a switch has energized a hot terminal. These and other features, aspects, and advantages of the present invention will become better understood with regard to the following description, claims, and accompanying drawings.

DRAWINGS

DESCRIPTION

The invention in its simplest form comprises a two-outlet switched receptacle wired with an LED that turns on when the corresponding switch energizes the circuit. One example of specific circuitry that can perform this function comprises a standard two-outlet receptacle having two respective hot terminals and two respective neutral terminals, a resistor electrically connected to a first outlet neutral terminal; a light-emitting diode ("LED") having a first lead and a second lead electrically connected by the LED first lead in series with the resistor, and the second lead electrically connected to a first outlet hot terminal; and a rectifier diode electrically connected in parallel across the LED first lead and second lead, whereby the LED is activated whenever a switch has energized a hot terminal. It is understood that other circuits can be designed to do the same function, and that they would fall within the coverage of this invention.

Figure 1:
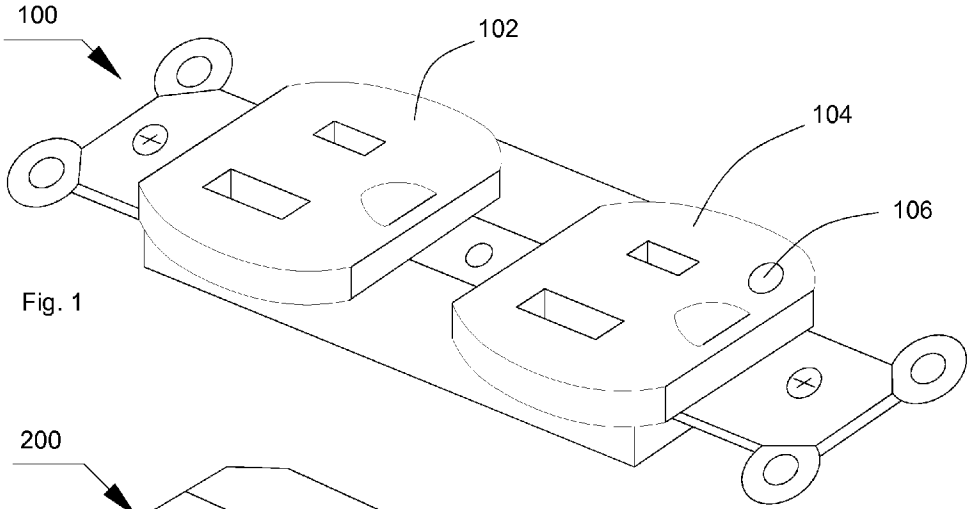
FIG. 1 is an orthogonal view of a top receptacle portion according to the present invention.

Turning to FIG. 1, a top receptacle portion 100 comprises a first two-prong outlet 104 and a second two-prong outlet 102. Preferably, the first outlet 104 and second outlet 102 are co-planar with the top receptacle portion 100. The top receptacle portion further comprises a through hole 106 for receiving the LED perpendicular to the plane of first outlet and second outlet.

Figure 2:
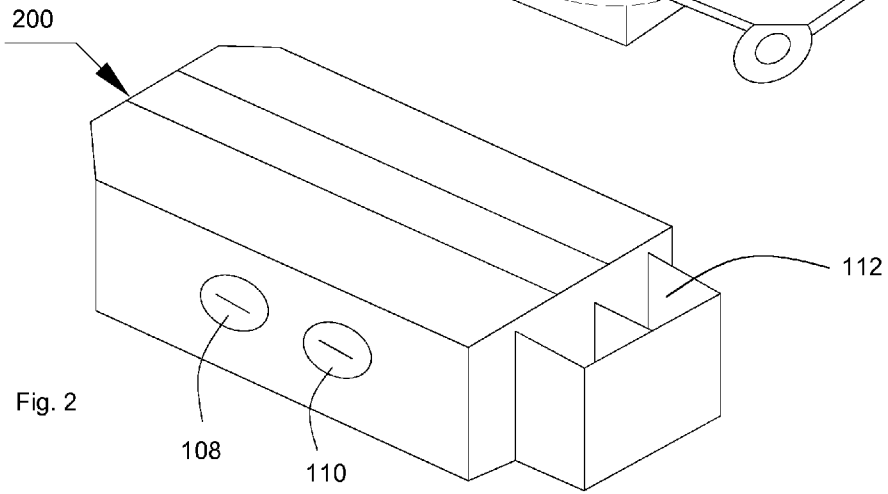
FIG. 2 is an orthogonal view of a bottom receptacle portion according to the present invention.

The top receptacle portion 100 fits on top of a bottom receptacle portion 200 shown in FIG. 2. A first outlet neutral terminal 108 and second outlet neutral terminal 110 are shown in this view. Structure defining a recess 112 sized to receive an LED wired to a rectifier diode is provided in the bottom receptacle portion 200.

Figure 3:
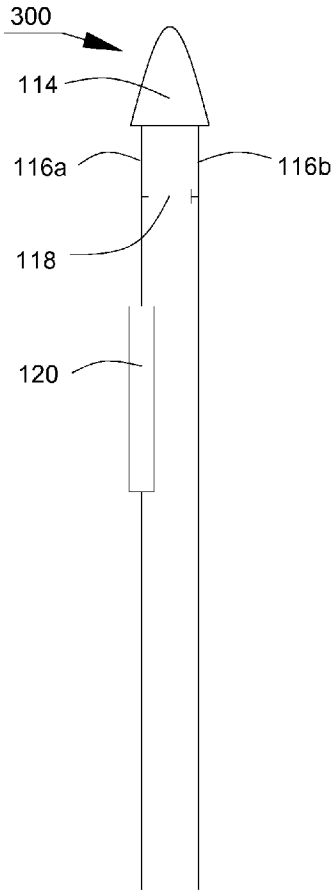
FIG. 3 is a plan view of an LED, rectifier diode, and resistor assembly according to the present invention.

FIG. 3 shows the details of an LED assembly 300 having an LED 114 that has two leads 116*a*, 116*b*. The LED is preferably a 5 mm, 2.1 V, 30 mA LED. A green color LED is preferred but other colors can be used. Other LEDs could be used.

A resistor 120 is electrically connected in series to the LED first lead 116. The resistor 120 can be a nominal 33 k-ohm, ½ W, 5% tolerance resistor, but other resistors could be used.

A rectifier diode 118 is electrically connected in parallel with the LED leads 116*a*, 116*b*. The rectifier diode 118 can be a type IN4005 rectifier diode, but others could be used.

Figure 4:
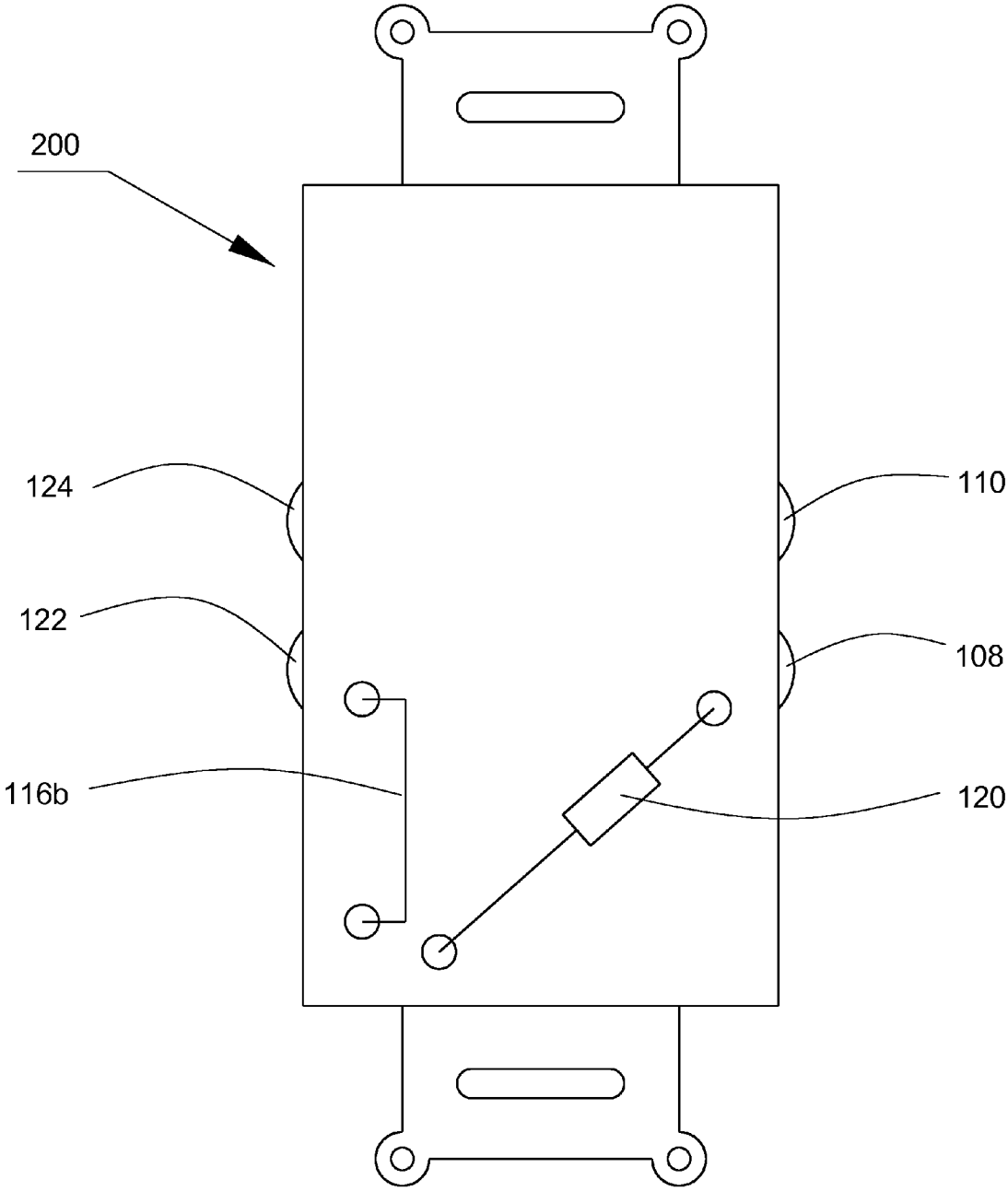
FIG. 4 is a rear plan view of a switched duplex receptacle according to the present invention.
Figure 5:
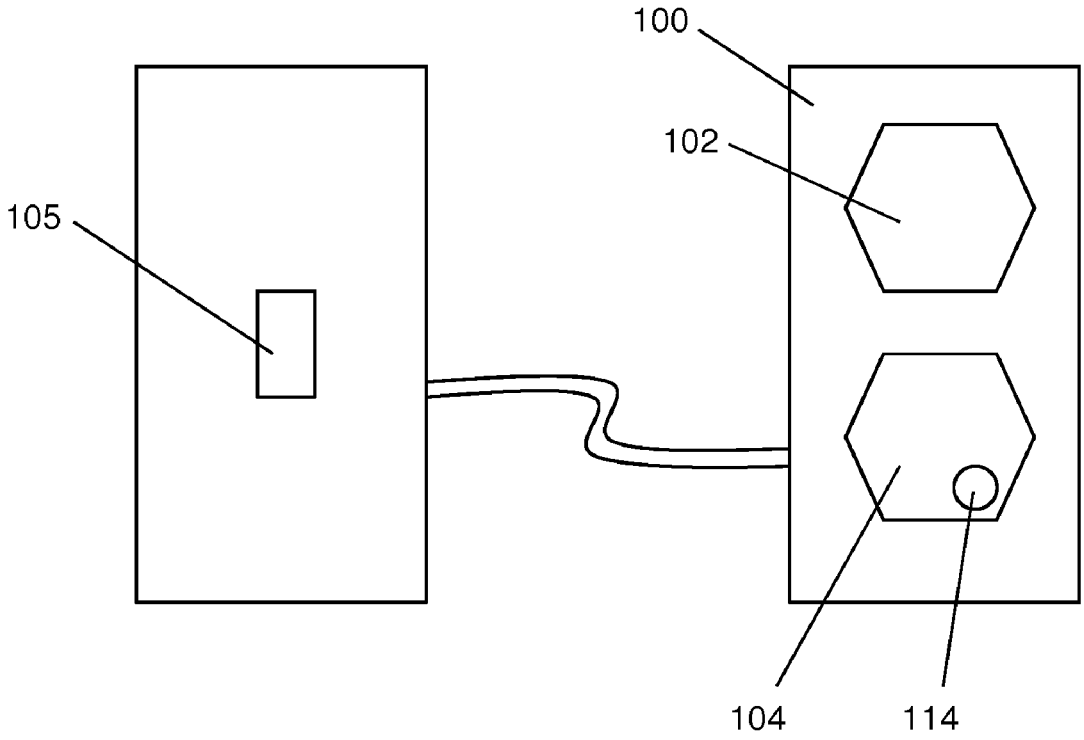
FIG. 5 is a front plan view of a switched duplex receptacle and wall switch according to the present invention.

FIG. 4 shows the back of the switched duplex receptacle assembled according to the present invention. Although not shown, the first outlet 104 is electrically connected to a first outlet hot terminal 122 and a first outlet neutral terminal 108. The second outlet 102 is electrically connected to a second outlet hot terminal 124 and a second outlet neutral terminal 110.

The resistor end that is not connected to the LED first lead 116*a* is electrically connected to the first outlet neutral terminal 108. The second LED lead 116*b* is electrically connected to the first outlet hot terminal 122.

When wired as shown without the hot terminals electrically connected, a user turns can turn on a switch 105 connected to the duplex receptacle, and the LED 114 will light up, indicating that the switch 105 controls that first receptacle 104. Use of this circuit with an LED has many benefits. The circuit is simple to make and uses very little energy. The invention can be retrofitted into existing duplex receptacles. In fact the LED assembly 300 can be provided pre-assembled as a kit for installation in the field. In the alternative, switched receptacles can also be fabricated with this circuit built in.

A method of making the invention has the following steps. First, a switched duplex receptacle is provided comprising a first two-prong outlet 104 and a second two-prong outlet 102; a first outlet hot terminal 122 electrically connected to the first outlet 104; a first outlet neutral terminal 108 electrically connected to the first outlet; a second outlet hot terminal 124 electrically connected to the second outlet 102; and a second outlet neutral terminal 110 electrically connected to the second outlet 102. An LED 114 having two leads 116*a*, 116*b* is provided, as well as a resistor 120, and a rectifier diode 118.

Next, electrically connect the rectifier diode 118 in parallel across the two LED leads 116*a*, 116*b*. Then electrically connect the resistor in series with the first LED lead 116*a*.

Make a hole 106 in the receptacle 100 for receiving the LED 114 and rectifier diode 118. Since the preferred LED is a 5 mm LED, the hole 106 should be slightly larger than 5 mm in diameter. Insert the LED assembly 300 through the hole 106 so that the leads can be attached to terminals from the bottom.

Electrically connect the resistor 120 to the first outlet neutral terminal 108. Finally, electrically connect the second LED lead 116*b* to the first outlet hot terminal 122.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. A switched receptacle system with a light emitting diode (LED) indication comprising:

a wall switch constructed and arranged to be embedded into a wall; and a residential grade receptacle device disposed in electrical communication with the wall switch, the device having:

a top receptacle portion comprising a first two-prong outlet and a second two-prong outlet;

a bottom receptacle portion comprising:

a first outlet hot terminal electrically connected to the first outlet, the first outlet hot terminal constructed and arranged to (i) receive power from a power source when the wall switch is turned on and (ii) become non-energized when the wall switch is turned off;

a first outlet neutral terminal electrically connected to the first outlet;

a second outlet hot terminal electrically connected to the second outlet, the second outlet hot terminal constructed and arranged to receive power from the power source regardless of whether the wall switch is turned on or is turned off; and a second outlet neutral terminal electrically connected to the second outlet;

a resistor electrically connected to the first outlet neutral terminal;

an LED comprising a first lead electrically connected in series with the resistor, and a second lead electrically connected to the first outlet hot terminal; and a rectifier diode electrically connected in parallel across the LED first lead and second lead, whereby the LED (i) is activated whenever the wall switch is turned on indicating that the first outlet hot terminal is receiving power from the power source, and (ii) is deactivated whenever the wall switch is turned off indicating that the first outlet hot terminal is non-energized.

2. The system of claim 1, wherein the resistor is a nominal 33 k-ohm resistor.

3. The system of claim 2, wherein the resistor is a 33 kΩ, ½ W, 5% tolerance resistor.

4. The system of claim 1, wherein the LED is a 30 mA LED.

5. The system of claim 4, wherein the LED is a 5 mm, 2.1 V 30 mA LED.

6. The system of claim 1, wherein the first outlet and second outlet are co-planar with the top receptacle portion, the top receptacle portion further comprising a through hole for receiving the LED perpendicular to the plane of first outlet and second outlet.

7. The system of claim 6, the bottom receptacle portion further comprising a recess for receiving the LED and the rectifier diode within.

* * * * *